United States Patent [19]

Smith et al.

[11] 4,231,284

[45] Nov. 4, 1980

[54] LOAD EQUILIZATION FEEDBACK FOR PARALLEL CHANNEL SERVO ACTUATORS

[75] Inventors: Alan C. Smith, Newhall; Manfred A. Runkel, Valencia, both of Calif.

[73] Assignee: Textron, Inc., Providence, R.I.

[21] Appl. No.: 938,578

[22] Filed: Aug. 31, 1978

[51] Int. Cl.[3] ..... F01B 25/04; F15B 11/22; F15B 13/16

[52] U.S. Cl. ..... 91/171; 91/384

[58] Field of Search ..... 91/171, 384

[56] References Cited

U.S. PATENT DOCUMENTS

| | | | |
|---|---|---|---|
| 2,706,886 | 4/1955 | Michel | 91/171 |
| 2,729,943 | 1/1956 | Clark et al. | 91/171 |
| 2,859,591 | 11/1958 | Zimmermann | 91/171 |
| 3,677,137 | 7/1972 | Stockwell | 91/171 |

FOREIGN PATENT DOCUMENTS

| | | | |
|---|---|---|---|
| 570423 | 12/1957 | Italy | 91/171 |
| 652001 | 4/1951 | United Kingdom | 91/171 |

OTHER PUBLICATIONS

Seaplane with Retractable Planing Bottom in Engineering, Aug. 31, 1945, pp. 165, 166 and 170, by Messrs. Blackburn Aricraft, Limited.

*Primary Examiner*—Paul E. Maslousky

*Attorney, Agent, or Firm*—Nilsson, Robbins, Dalgarn, Berliner, Carson & Wurst

[57] ABSTRACT

A parallel actuator pair force transmission system including a mechanical feedback apparatus capable of detecting differential movement between the actuator pair and providing a feedback signal to control valves phased in such a manner as to correct for and counteract the differential motion between the actuator pair.

2 Claims, 5 Drawing Figures

LOAD EQUILIZATION FEEDBACK FOR PARALLEL CHANNEL SERVO ACTUATORS

BACKGROUND OF THE INVENTION

In applications requiring force transmission in hydraulic systems, there is a desirability for utilization of actuator pairs. In the prior art when the actuators are arranged in parallel, a very small differential in pressure across the pistons in each of the actuators can result in a mismatch in piston movement within the cylinders. Such mismatch in piston movement (differential movement between the pistons) results in a lateral deflection of the actuators. Such lateral deflection impairs performance of the actuator pair and thus reduces the reliability thereof. In addition, the pistons, as a result of the lateral deflection, may bind within the cylinders, thereby reducing the life of the actuators through unusual wear of the pistons, the seals and the internal cylinder walls.

To correct the foregoing problems, when the application requires the utilization of parallel actuators, very complicated pressure synchronization systems must be employed. Such complicated systems in turn reduce the reliability and increase the cost of manufacture as well as maintenance of the system.

SUMMARY OF THE INVENTION

Mechanical feedback apparatus having a load synchronization capability in a parallel actuator pair force transmission system which includes separate control valves for each of the actuators, means connected to the actuators to detect differential motion therebetween and means for applying the detected differential motion to the control valve means in a phase such as to counteract the differential motion.

DETAILED DESCRIPTION OF THE INVENTION

Figure 1:
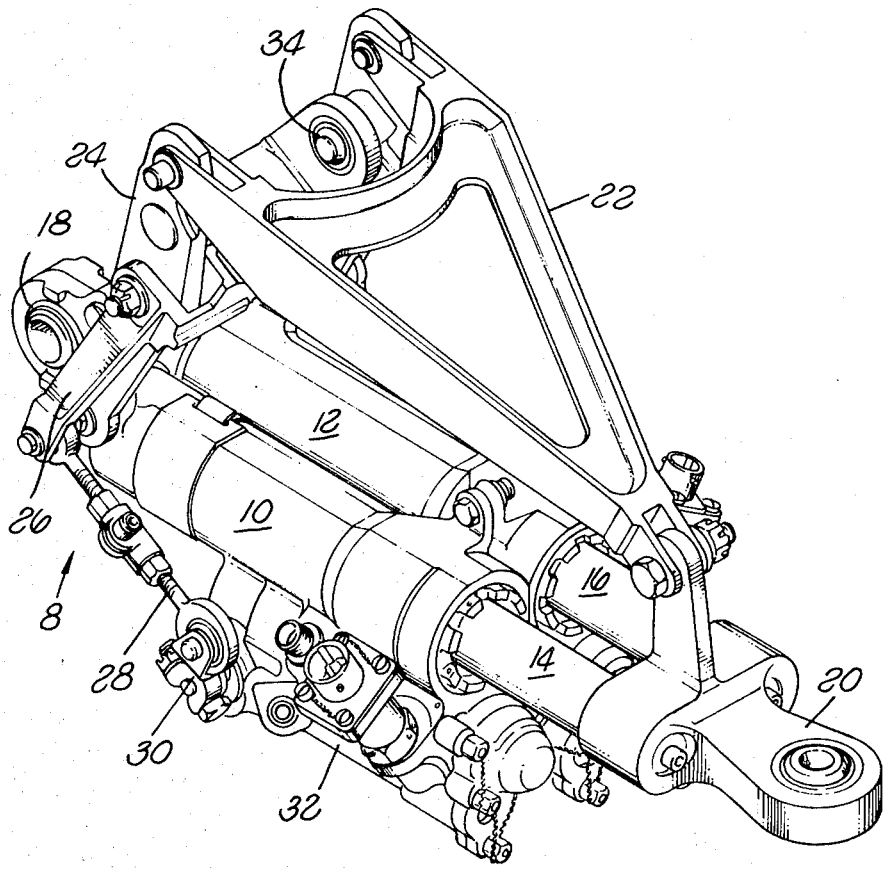
FIG. 1 is a perspective view of a parallel actuator pair including the mechanical feedback apparatus having load synchronization capability in accordance with the present invention.

As shown in FIG. 1, a parallel actuator pair 8 includes a pair of cylinders 10–12 housing a pair of reciprocally movable pistons (not shown) to which are connected piston rods 14–16, respectively. Appropriate fittings 18–20 are associated with the cylinders and piston rods, respectively, to mount the actuator pair in accordance with any desired application for the transmission of force. One example of use is as to a control surface in an aircraft as reciprocal relative movement between the piston rods and the cylinders occur through application of fluid under pressure across the pistons. A mechanical feedback linkage 22 overlies said cylinders 10–12 and is connected through a summing link 24 and an input link 26 through an adjustable link 28 to the control valve input 30 of the control valve 32. The input link 26 may also include a connection 34 for receiving input signals from flight control mechanisms such as the pilot, auto-pilot, or flight augmentation systems, as is well known. The system as thus described, including the actuator pair with an appropriate feedback, summing and input linkage is well known and operates in accordance with well understood principles. However, such a structure as generally described will not automatically counteract for mismatch between the actuator pair.

Figure 2:
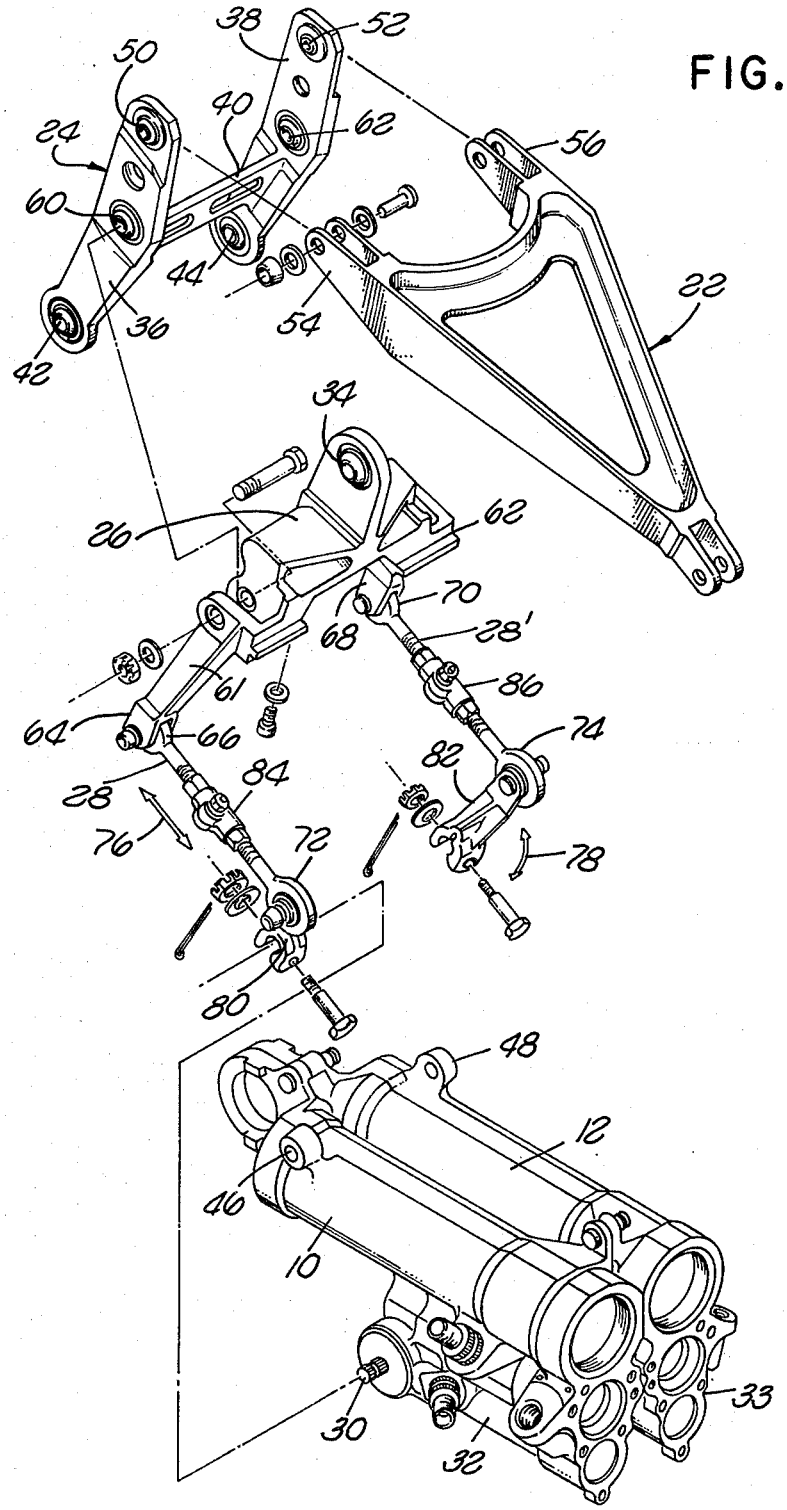
FIG. 2 is an exploded view of a partially disassembled actuator pair as illustrated in FIG. 1 more clearly illustrating the mechanical feedback apparatus having the load synchronization capability.

As more clearly shown in FIG. 2, to which reference is hereby made, through the utilization of a summing link 24 which is flexible in torsion, any differential motion between the piston rods 14–16 will be applied to the control valves 32. As is shown in FIG. 2, the summing link 24 includes a first leg 36 and a second leg 38 interconnected by a flexible web 40. The legs 36 and 38 of the summing link 24 are anchored at the ends 42 and 44 thereof to lugs 46 and 48 provided on the cylinders 10–12 respectively. The opposite ends 50–52 thereof are connected to spaced apart arms 54 and 56, respectively of the feedback linkage 22. The opposite end 58 of the feedback linkage is connected to the fitting 20 (FIG. 1) on the piston rods 14–16. The fitting 20 couples the piston rod ends together to cause them to move as a unit.

The input linkage 26 is in turn connected at points 60 and 62 on the summing linkage 24, which points are intermediate the ends of the arms 36 and 38, respectively. As is illustrated, the input linkage 26 includes first and second legs 61 and 63. The leg 61 is connected at one end 64 thereof to the end 66 of the adjustable link 28. The end 68 of the leg 63 is connected to the end 70 of the adjustable link 28'. The opposite ends 72 and 74 of the adjustable links 28—28', respectively, are in turn connected to the input 30 of the control valves 32 for the actuator 10 and the control valve 33 for the actuator 12. As shown the cylinders 10–12 overlie the control valves 32–33 respectively, and are formed as part of the same housing.

By reference to FIGS. 1 and 2, those skilled in the art will appreciate the operation of the actuator assembly during normal circumstances without any force mismatch occurring between the actuators. If an input signal is applied to the input point 34 on the input linkage 26, the linkage will pivot about the points 60–62 thus causing the adjustable linkages 28—28' to move in a linear fashion as shown by the arrow 76 (depending upon the direction of application of the force to the point 34). The linear movement of the adjustable links in turn apply a rotary motion as shown by the arrow 78 through the crank arms 80 and 82 to the inputs to the values associated with the actuators 10–12 respectively. The values are standard slide valves, as known to those skilled in the art, which control the flow of hydraulic fluid from a source under pressure thereof to the cylinders on either side of the pistons slidably positioned therein. Such causes movement of the pistons and the piston rods, thereby applying force to the load connected to the actuator. As the piston rods move, mechanical feedback is applied through the feedback linkage 22 to the summing link 24 to move the input link and through appropriate movement of the adjustable links 28—28′ and the crank arms 80–82 to return the control valve to is null position when the actuator has reached the commanded position. As is illustrated, particularly in FIG. 2, the adjustable linkages 28—28′ each include adjusting members 84–86, respectively to enable synchronization of the actuators as closely as possible.

It has however been discovered that even under the best possible adjustment of the input linkages 28—28′ force mismatch between the actuators in a parallel actuator pair occurs. Such force mismatch generally causes a lateral displacement of the actuator pair to thereby render utilization of an actuator pair inoperable under many applications. This mismatch problem occurs because such systems normally have a small amount of slack or play in the mechanical connections. Such play coupled with high pressure gains can cause application of full pressure to one cylinder with little or no pressure to the other cylinder. Since the opposite ends of the actuators are secured the actuator pair responds by flexing, i.e. laterally moving with the attendant problems above referenced.

Figure 3:
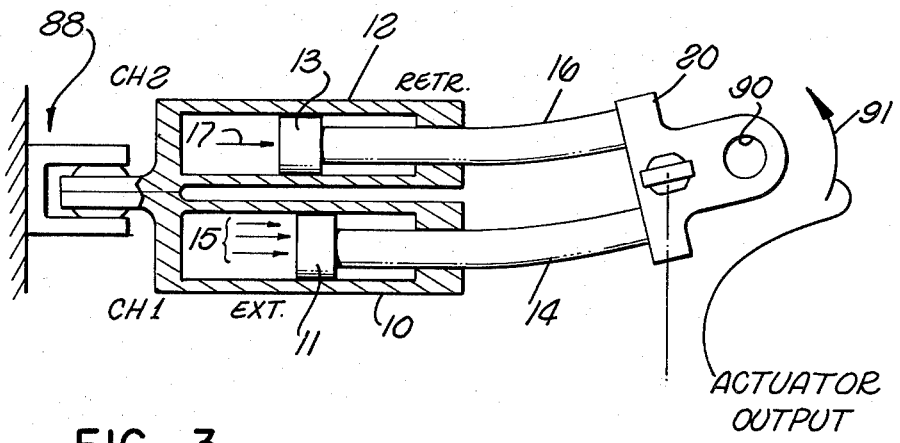
FIG. 3 is a schematic diagram, partly in cross section illustrating differential motion between a parallel actuator pair and the results thereof.

By reference to FIG. 3, such mismatch is schematically illustrated. The same reference numerals previously employed are used for the same parts. As is therein illustrated a pair of cylinders, for example, 10–12 include pistons 11 and 13 slidably disposed therein, with piston rods 14 and 16 connected thereto. The fitting 20 is connected to the piston rods 14 and 16 while the fitting 18 is connected to the cylinders 10 and 12 to thereby cause the actuator pairs to function as a unit. The fitting 18 is anchored to a structural attachment 88, while the fitting 20 is attached through the opening 90 to an appropriate load.

Figure 4:
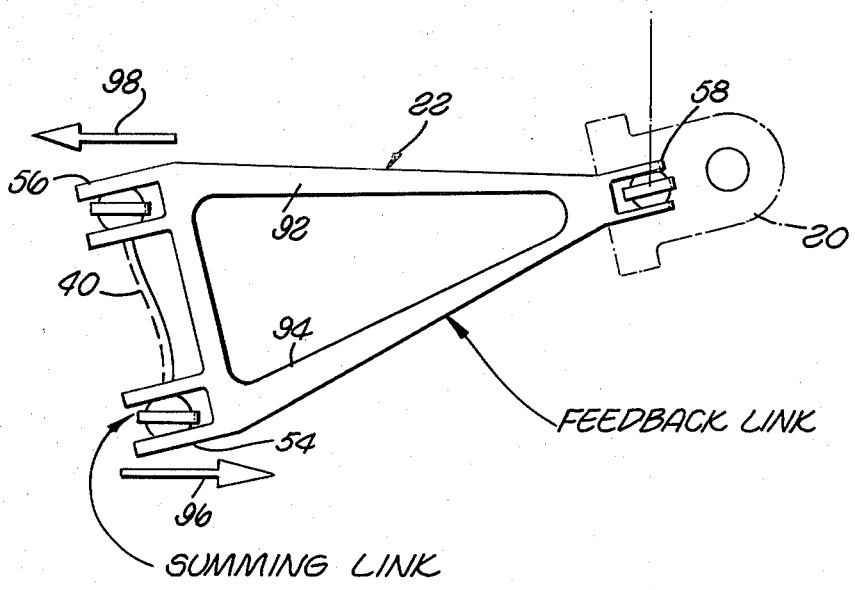
FIG. 4 is a schematic diagram illustrating the feedback linkage as connected to an actuator pair as illustrated in FIG. 3.

Assuming a mismatch in the inputs to the control valves which are associated with each of the cylinders 10–12, a differential pressure can occur across the pistons 11–13. Such differential pressure can cause relative movement between the pistons 11–13. As above pointed out, the actuators will be laterally displaced, however for ease of description such relative movement is schematically represented as a lateral displacement of the rod end fitting 20 as represented by the arrow 91 such movement assumes the forces applied to the lefthand side (as viewed in FIG. 4) of the piston 11 are greater than the forces applied to the lefthand side of piston 13 and such is represented by differences in the arrows 15 and 17 respectively. The amount of deflection illustrated is greatly exaggerated for purposes of clarity of illustration and description.

Since the feedback linkage 22 is connected at its point 58 to the fitting 20 the feedback linkage is also displaced along with the fitting 20 in the direction of the arrow 91. As is illustrated, the feedback linkage 22 is formed having a pair of arms 92 and 94 which diverge from the point 58 thereof so as to provide the spaced apart connections 54 and 56 to the summing link 24. The connection between the feedback link 22 and the summing link 24 is pivotally connected. The two ends 54 and 56 of the summing link will rotate in a counterclockwise direction assuming lateral displacement as illustrated by the arrow 91 (FIG. 3.) Such counterclockwise rotation is illustrated by the arrows 96 and 98. The flexible web 40 on the summing link allows such rotation. As the two legs 36 and 38 of the summing link 24 thus move, the input link is caused to respond accordingly, thereby applying an input signal through the adjustable links 28—28′ in opposite directions to compensate for the differential pressure appearing across the pistons 11 and 13 to thereby synchronize the movement thereof and eliminate the lateral displacement above referred to. The gain of the feedback 22 is determined by the ratio between the length thereof to one-half the distance between the connections 54–56.

Figure 5:
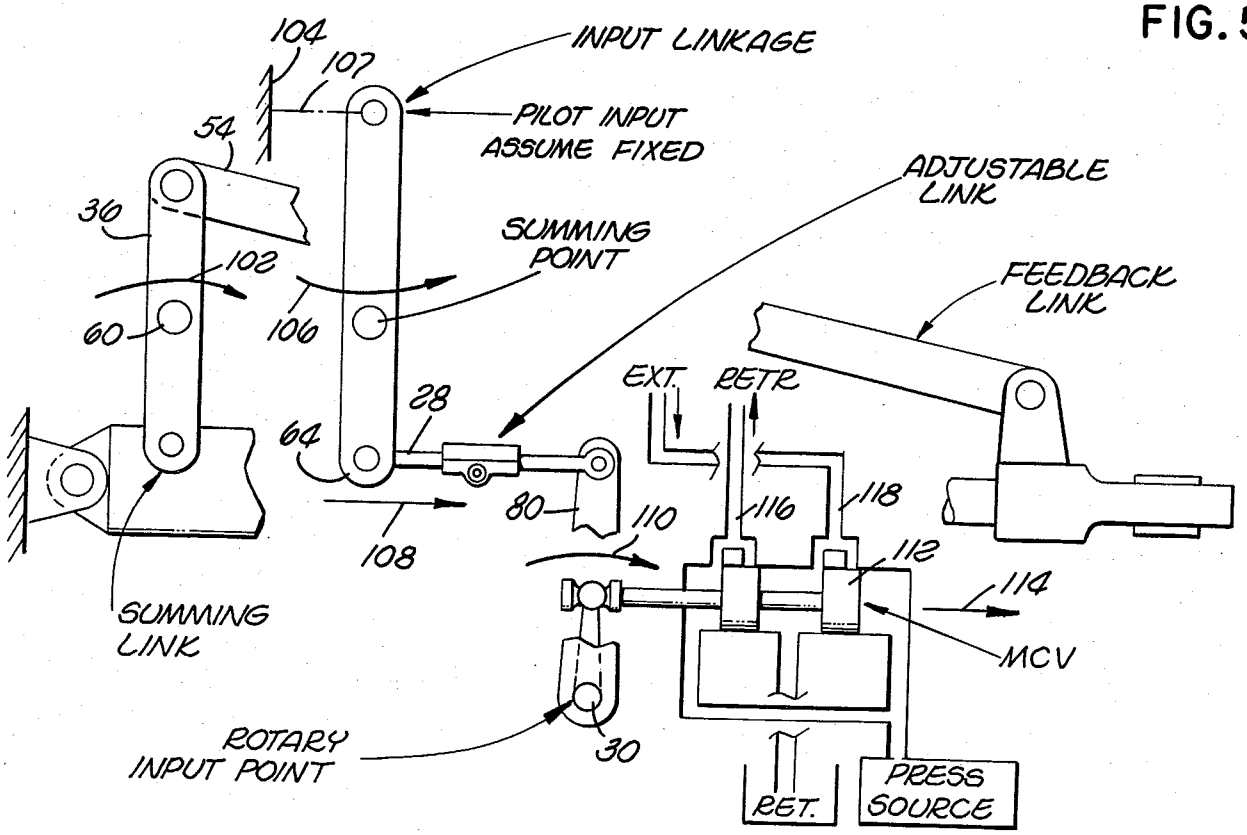
FIG. 5 is a schematic diagram illustrating the connection of a feedback signal generated by the differential movement of the actuator pair illustrated in FIGS. 3 and 4 to a control valve.

This operation is more fully illustrated in the schematic of FIG. 5 to which reference is now made and in which there is shown, a side elevational view of that portion of the system associated with the cylinder 10. As is thus illustrated, as the end 54 of the arm 94 (FIG. 4) on the feedback linkage 22 moves to the right, as shown by arrow 96, the summing link leg 36 also moves to the right, as is shown by the arrow 102. It will be assumed for purposes of discussion that the input link is not being moved by any application of force to the input point 34 thereof. Such is illustrated by the ground symbol 104 connected thereto by the line 107. Thus as the point 60 on the leg 36 moves to the right, the arm 61 of the input link is also caused to move to the right as shown by the arrow 106. Such movement to the right is applied through the adjustable linkage 28 as shown by the arrow 108 to move the crank arm 80 to the right as shown by the arrow 110. Such movement in turn causes the slide valve 112, within the control valve 32, to move to the right as shown by the arrow 114. Such movement causes the hydraulic fluid under pressure (PRESS) to be applied through the retract (RETR) conduit 116 while return (RET) is connected to the extend (EXT) conduit 118 thereby tending to reverse the application of differential pressure across the piston 11 as previously applied. A similar but reverse operation will occur with respect to the opposite side of the system associated with the actuator 12 thereby applying pressure from the source thereof to the extend conduit and return to the retract conduit, thus again tending to reverse the application of differential pressure across the piston 13. Such application of pressures significantly reduces the lateral displacement of the actuator as illustration in FIG. 3. As such occurs, through the feedback mechanism as above described, the summing link will return the inputs of the control valves to a null position. It will be obvious to those skilled in the art that if the differential pressures are in the opposite direction from those above described with respect to FIG. 3, then lateral displacement of the actuators will occur in a direction opposite that illustrated by the arrow 90 and the entire operation of the system as above described with respect to FIGS. 3 through 5 will be opposite to that as described.

In either event, irrespective of the direction of lateral displacement of the actuators, the feedback system synchronizes the position of the pistons thereby to substantially reduce the lateral displacement.

What is claimed is:

1. Mechanical feedback apparatus having load synchronization in a parallel pair force transmission system comprising:

(A) a pair of actuators each having a housing including a cylinder, a piston and a piston rod;

(B) means connecting said cylinders rigidly together in side by side relationship with said piston rods extending from said cylinders in the same direction;

(C) means connecting said piston rods rigidly together at one end thereof outside said cylinders;

(D) a separate control valve means for each of said actuators and formed as a part of the housing for its respective actuator for controlling the application of fluid under pressure from a source thereof to said actuators to cause relative movement between said pistons and their respective cylinders;

(E) means anchoring one of said cylinders and said piston rods;

(F) means connected between the other of said cylinders and piston rods and said control valve means including:

1 a rigid feedback member having a pair of diverging arms, 2 a summing link having a pair of spaced apart legs interconnected with a flexible web so that said link is flexible in torsion, said arms being connected to said legs, whereby differential lateral motion between said pistons and cylinders is detected by said feedback members and is applied to said control valve means through said link for counteracting said differential lateral motion.

2. Apparatus for load synchronization as defined in claim 1 which further includes a separate input signal applying means and means coupling said input signal applying means to said summing link.

* * * * *